US005806446A

United States Patent [19]

Morrison et al.

[11] Patent Number: 5,806,446

[45] Date of Patent: Sep. 15, 1998

[54] INDIVIDUAL YARN FEEDING APPARATUS

[75] Inventors: Gerald Morrison, Ringgold, Ga.; M. Steven Berger, Chattanooga, Tenn.

[73] Assignee: Modern Techniques, Inc., Ringgold, Ga.

[21] Appl. No.: 802,835

[22] Filed: Feb. 18, 1997

[51] Int. Cl.[6] ..... D05B 15/18

[52] U.S. Cl. ..... 112/80.73

[58] Field of Search ..... 112/80.01, 80.7, 112/80.73, 80.54

[56] References Cited

U.S. PATENT DOCUMENTS

| | | | |
|---|---|---|---|
| 2,842,080 | 7/1958 | Hoeselbarth . | |
| 2,850,994 | 9/1958 | Crawford . | |
| 3,095,841 | 7/1963 | Ballard et al. . | |
| 3,943,865 | 3/1976 | Short et al. . | |
| 4,173,192 | 11/1979 | Schmidt . | |
| 4,226,196 | 10/1980 | Booth . | |
| 4,267,787 | 5/1981 | Fukuda . | |
| 4,398,479 | 8/1983 | Czelusniak, Jr. . | |
| 4,411,207 | 10/1983 | Brock et al. | 112/80.73 |
| 4,864,946 | 9/1989 | Watkins | 112/80.73 |
| 5,058,518 | 10/1991 | Card et al. . | |
| 5,182,997 | 2/1993 | Bardsley | 112/80.73 |
| 5,544,605 | 8/1996 | Frost | 112/80.73 X |
| 5,622,126 | 4/1997 | Card et al. | 112/80.73 |

*Primary Examiner*—Paul C. Lewis
*Attorney, Agent, or Firm*—Pitts & Brittian, P.C.

[57] ABSTRACT

An individual yarn feeding apparatus (10) for compensating for variations in the feed rate of individual yarn threads due to the lateral shifting of needle bars in various selected pile heights between tufts. The individual yarn feeding apparatus (10) is positioned between the yarn beam and the needle bar of a conventional tufting machine. The apparatus (10) includes a support arm (12) carried by the tufting machine, at least one thread guide (14) disposed proximate a first end (16) of the support arm (12), and at least one feed rate control device (20) received on the support arm (12). The thread guide (14) separates the individual yarn threads as they pass from the yarn beam, through the apparatus (10) and to the needle bar. The feed rate control device (20) enables the definition of an accent yarn feed path (22) and a base yarn feed path (24). In operation, the feed rate control device (20) varies in the speed of weaving the accent yarn threads to compensate for the shifting of the needle bars, thereby controlling the pile height achieved in tufting to define a particular design and pattern of the finished tufted product.

17 Claims, 7 Drawing Sheets

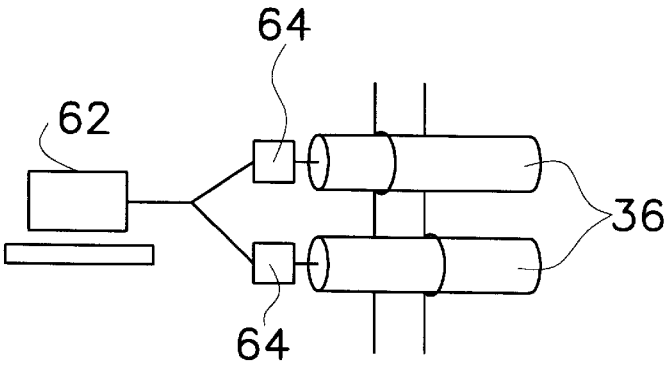
Fig.9
(AMENDED)

INDIVIDUAL YARN FEEDING APPARATUS

TECHNICAL FIELD

This invention relates to the field of tufting machines. More specifically, this invention relates to an apparatus for compensating for variations in the required feed rate of yarn due to the lateral shifting of needle bars in various selected pile heights between tufts.

BACKGROUND ART

In the field of carpet weaving and carpet weaving machines, it is well-known that the process to set-up a tufting machine to weave a particular pattern is particularly difficult and labor intensive. In current practice, conventional tufting machines require that each individual strand of yarn be hand fed from a yarn beam, about a first and a second yarn conveying roller and into a threading needle on a needle bar. The order of threading the yarn strands through this system is determined by the particular pattern which is to be woven. The difficulty and labor intensity of this process arises from the time required to hand feed each individual yarn strand through this system. A limitation of this method is that only a small number of strands can be utilized in the weaving process at any given time. Another limitation arises where a thread of yarn has been mis-fed, resulting in an incorrect or erratic pattern. The result of such mis-feeds is great waste of weaving raw materials and additional man-hours of labor to correct the error. Set-up of the weave for a particular pattern or interchange between weaving patterns can require as much as three shifts of labor for completion.

Other devices have been produced to feed yarn from a yarn beam to the needle bars of a tufting machine. Typical of the art are those devices disclosed in the following U.S. Patents:

| U.S. Pat. No. | Inventor(s) | Issue Date |
|---|---|---|
| 2,842,080 | F. W. E. Hoeselbarth | Jul 8, 1958 |
| 2,850,994 | A. H. Crawford | Sep 9, 1958 |
| 3.095,841 | H. W. Ballard, et al. | Jul 2, 1963 |
| 3,943,865 | J. T. Short, et al. | Mar 16, 1976 |
| 4,173,192 | H. A. Schmidt, et al. | Nov 6, 1979 |
| 4,226,196 | D. Booth | Oct 7, 1980 |
| 4,267,787 | T. Fukuda | May 19, 1981 |
| 4,398,479 | P. A. Czelusniak, Jr. | Aug 16, 1983 |
| 5.058,518 | R. T. Card, et al. | Oct 22, 1991 |

Of these devices, those disclosed by Hoeselbarth ('080), Crawford ('994), Ballard, et al. ('841) and Short, et al. ('865) are directed towards devices designed to allow variation of the pile height to create a contoured carpet.

Schmidt, et al. ('192) discloses a electro-hydraulic needle bar positioning apparatus for a tufting machine which transversely or laterally shifts the needle bar or backing fabric according to a pre-determined pattern.

The Booth device ('196) is a sliding needle bar tufting machine in which each of two needle bars are mounted to permit a warp-wise direction adjustment between the two rows of needles to increase pattern size in warp and weft directions as well as the overall pattern variations achievable in tufted textile fabric.

Fukuda ('787) discloses a method for controlling the weaving speed of a tufting machine which includes measuring a number of stitches and the feeding yarn length for a unit feed length of ground fabric and controlling the feed of either the yarn or the fabric to achieve a uniform height and finish throughout a tufted carpet.

The Czelusniak device ('479) includes a pair of needle bars which are indexed such that the two rows of needles are aligned to form a single row of needles. The two individual needle bars are held in abutment in the lower portion of the needle stroke using a tension spring member. At the top of the stroke, a lever is engaged to separate the two needle bars one from the other. A pattern means then shifts the needle bars as required to accomplish the selected design. The two needle bars are attached at their respective ends in essentially a loop configuration such that as one is moved in one direction, the other is moved in the opposite direction an equal distance.

Card, et al. ('518) discloses a tufting machine incorporating a pair of needle bars which may be moved with respect to one another. The needle bars are spaced apart in the direction of travel of the backing fabric. The needle bars may thus be moved transversely to approximate a selected pattern.

None of the prior art devices discloses the use of an individual yarn feeding apparatus which compensates for variations in the feed rate of yarn due to the lateral shifting of needle bars in various selected pile heights between tufts. Nor do any of the prior art devices show the use of an individual yarn feeding apparatus for variably controlling the feeding of a plurality of yarn strands from a yarn beam to the individual needles of a needle bar on a conventional tufting machine. Nor do any of these devices provide a means for quickly selecting the yarns within a group to be fed using the same feed rate profile.

Therefore, it is an object of this invention to provide an apparatus for feeding a plurality of yarn strands from a yarn beam to the needle bars of a tufting machine.

It is another object of this invention to provide a yarn feeding apparatus which utilizes a thread guide to facilitate the employment of a plurality of yarn strands while insulating the individual strands from entanglement or combination.

Further, it is an object of this invention to provide an individual yarn feeding apparatus for simultaneously feeding a plurality of yarn strands which is efficiently set-up for a tufting process.

It is also an object of this invention to provide an individual yarn feeding apparatus for simultaneously feeding a plurality of yarn strands which is efficiently broken-down upon completion of the tufting process.

Another object of this invention is to provide an individual yarn feeding apparatus for simultaneously feeding a plurality of yarn strands which is efficiently interchange between two weaving processes or patterns and re-set when a correction in the weave pattern is required.

Moreover, it is an object of this invention to provide an individual yarn feed apparatus having a means for quickly selecting the yarns within a group to be fed using the same feed rate profile.

It is an object of this invention is to provide an individual yarn feeding apparatus for simultaneously feeding a plurality of yarn strands which is efficiently re-set when a correction in the weave pattern is required.

It is also an object of this invention to provide a yarn feeding apparatus which is integrable into a system of simultaneously engaged yarn feeding apparati such that broader areas of carpet backing can be woven at one time, thus enhancing overall carpet production.

DISCLOSURE OF THE INVENTION

Other objects and advantages will be accomplished by the present invention which serves to compensate for variations in the required feed rate of yarn due to the lateral shifting of needle bars in various selected pile heights between tufts. The individual yarn feeding apparatus of the present invention is positioned between the yarn beam and the needle bar of a conventional tufting machine. The apparatus includes a support arm carried by the tufting machine, at least one thread guide disposed proximate a first end of the support arm, and at least one feed rate control device received on the support arm. The thread guide separates the individual yarn threads as they pass from the yarn beam, through the apparatus and to the needle bar. The feed rate control device enables the definition of an accent yarn feed path and a base yarn feed path. In operation, the device controls the accent yarn thread feed rate to the needle bar, thereby defining a selected weave pattern in the backing fabric.

The support arm is carried by the tufting machine in a relative parallel position with respect to the base yarn feed path. The support arm is fabricated from any durable material capable of bearing the load of at least one feed rate control device. The thread guide includes a plurality of through-openings for separating individual yarn threads as they are fed through the apparatus. The individual yarn threads are inserted through the individual through-openings of the thread guide and are fed to the individual needles of the needle bar in conventional fashion. Yarn threads extending from the thread guide to the needle bar define the base yarn feed path. The thread guide is fabricated from any material capable of withstanding both the overall structural tension resulting from the simultaneous pulling of multiple yarn threads through the through openings and the wear resulting from the repeated passage of the yarn threads through each of the individual through-openings.

The feed rate control device is received by the support arm so as to define a center line which is perpendicular to and above the base yarn feed path. The center line of the feed rate control device is coincident with a center line defined by the support bracket assembly and a center point defined by the yarn feed roller. The feed rate control device includes a support bracket assembly, a first and a second thread routing rod, and a yarn feed roller disposed between the bracket assembly and the routing rods. The thread routing rods are disposed in an equidistant lateral position from the center point of the yarn feed roller and in an equidistant vertical position between the center point of the yarn feed roller and the base yarn feed path, above the base yarn feed path.

The support bracket assembly is disposed above the yarn feed roller. The support bracket assembly includes a support bracket having a first and a second end, a bracket end plate disposed on the second end of the support bracket, a thread separating rod, and a thread grouping rod. The first end of the support bracket is received in the support arm. The thread separating rod and the thread routing rod each have a first end and a second end. The first end of each rod is removably received in the support bracket. The second end of each rod is removably received in the support bracket end plate. The bracket end plate receives each rod in a thread separating rod slot and a thread grouping rod slot, respectively. The thread separating rod and the thread grouping rod cooperatively enable the selective grouping of accent yarn threads to create a desired weave pattern and the rapid regrouping of those yarn threads when pattern profile modification or correction is desired.

The yarn feed roller is centrally positioned between the support bracket assembly and the thread routing rods. The yarn feed roller regulates the speed at which the yarn threads are fed to the needle bar of the conventional tufting machine. The thread grouping rod assists the yarn feed roller in regulating yarn thread speed by coordinately tensioning the accent yarn threads as they are drawn through the individual yarn feed apparatus. The yarn feed roller and support bracket assembly are positioned such that the points of contact between the yarn feed roller and thread grouping rod define a nip. The nip between the rod and the roller enhances the tractability of the yarn threads and the control of the movement of the threads through the apparatus.

The first and second thread routing rods are positioned immediately above and define the base yarn path for all yarn threads passing through the individual yarn feeding apparatus. They also assist in defining and directing accent yarn threads along the accent yarn path defined by the feed rate control device.

In operation, individual yarn threads are fed from the yarn beam through the individual yarn feed apparatus and to the individual needles of the needle bar in the conventional manner. As the yarn threads are fed through the apparatus, they are first passed through the individual through-openings of the thread guide, underneath both thread routing rods and to the individual needles of the needle bar, thus defining the base yarn feed path. The accent yarn threads are then separated from the base yarn feed path using the combination of the thread grouping and thread separating rods, in either of two manners. In a first manner, the thread grouping and thread separating rods are removed from their slots. The thread separating rod is inserted between and separates the accent yarn threads from the base yarn feed path and is returned to its original position. The thread grouping rod is then inserted in the space created by those portions of the accent yarn threads which straddle the thread separating rod and is positioned in the thread grouping rod slot. The thread grouping rod becomes the pivot point for the accent yarn threads upon the removal of the separating rod from its slot and from beneath the accent yarn threads. The yarn thread feeding process is then completed upon the return of thread separating rod to its respective slot. In an alternate manner, the thread separating rod is used to differentiate the accent yarn threads from the base yarn feed path by inserting rod in the base yarn feed path and using it to create a depression between the accent yarn threads and those yarn threads remaining on the yarn feed path. The thread grouping rod is then inserted into the space created between the accent yarn threads and the base yarn threads by depression of the base yarn feed path in place of the thread separating rod and the separating rod is restored to its slot. The thread grouping rod, bearing the accent yarn threads, is then returned to its slot on the support bracket assembly and the apparatus is set for operation.

When the tufting machine is in operation, the accent yarn threads are moved from the base yarn feed path, under the first thread routing rod, over the thread grouping rod, around a partial circumference of the yarn feed roller, under the second thread routing rod and then back to the base yarn feed path. Variations in the speed of weaving the accent yarn threads compensate for the shifting of the needle bars and control the pile height achieved in tufting to define a particular design and pattern of the finished tufted fabric product.

BRIEF DESCRIPTION OF THE DRAWINGS

The above mentioned features of the invention will become more clearly understood from the following detailed description of the invention read together with the drawings in which:

FIG. 9 is a schematic representation of an individual yarn feed apparatus of the present invention having a computer for regulating its operation.

BEST MODE FOR CARRYING OUT THE INVENTION

An individual yarn feeding apparatus incorporating various features of the present invention is illustrated generally at 10 in the figures. The individual yarn feeding apparatus 10 is designed to compensate for variations in the required feed rate of yarn due to the lateral shifting of needle bars and to compensate for various selected pile heights between tufts. Moreover, in the preferred embodiment, the individual yarn feeding apparatus 10 enables large numbers of accent yarn threads to be simultaneously fed from the yarn beam to the needle bar of a conventional tufting machine in a predetermined sequence to create a desired pattern in a tufted fabric product. The apparatus 10 also facilitates the correction of a mis-feed or the repair of breakage of yarn threads in a minimum time and with minimal waste.

Figure 1:
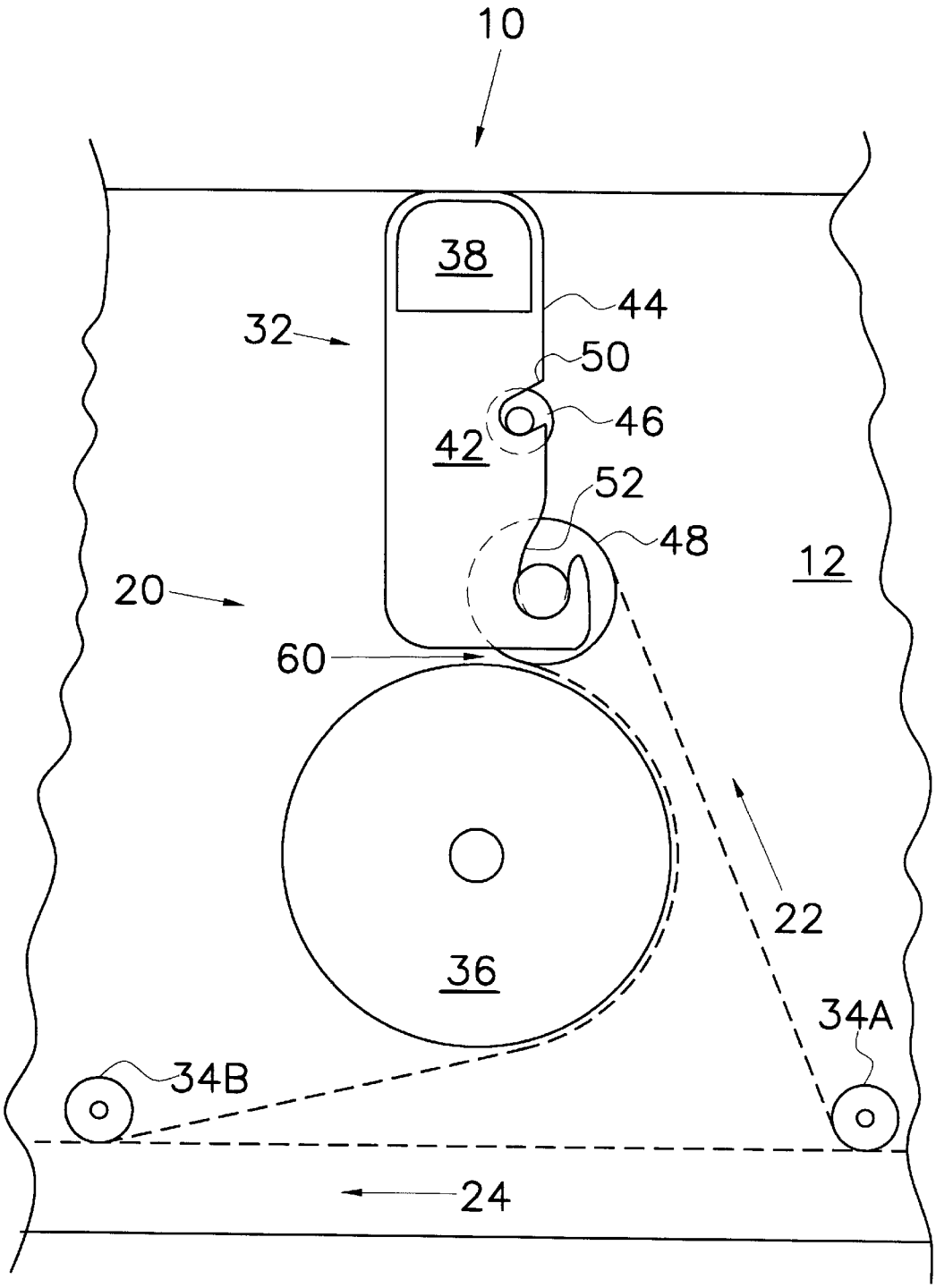
FIG. 1 is an elevation view of the individual yarn feeding apparatus constructed in accordance with several features of the present invention.
Figure 2:
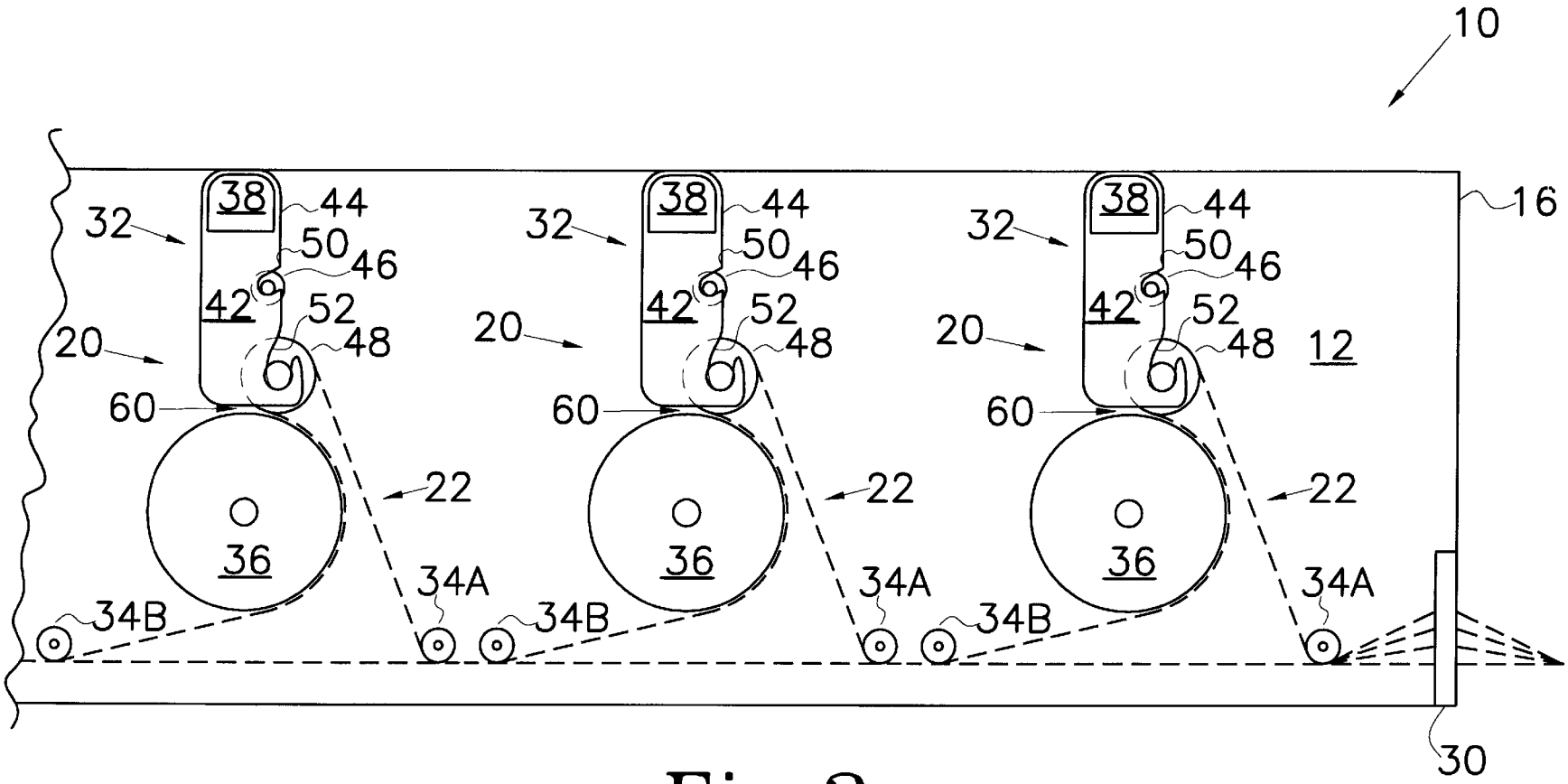
FIG. 2 illustrates an elevation view of a plurality of individual yarn feeding apparati taken in sequence.
Figure 3:
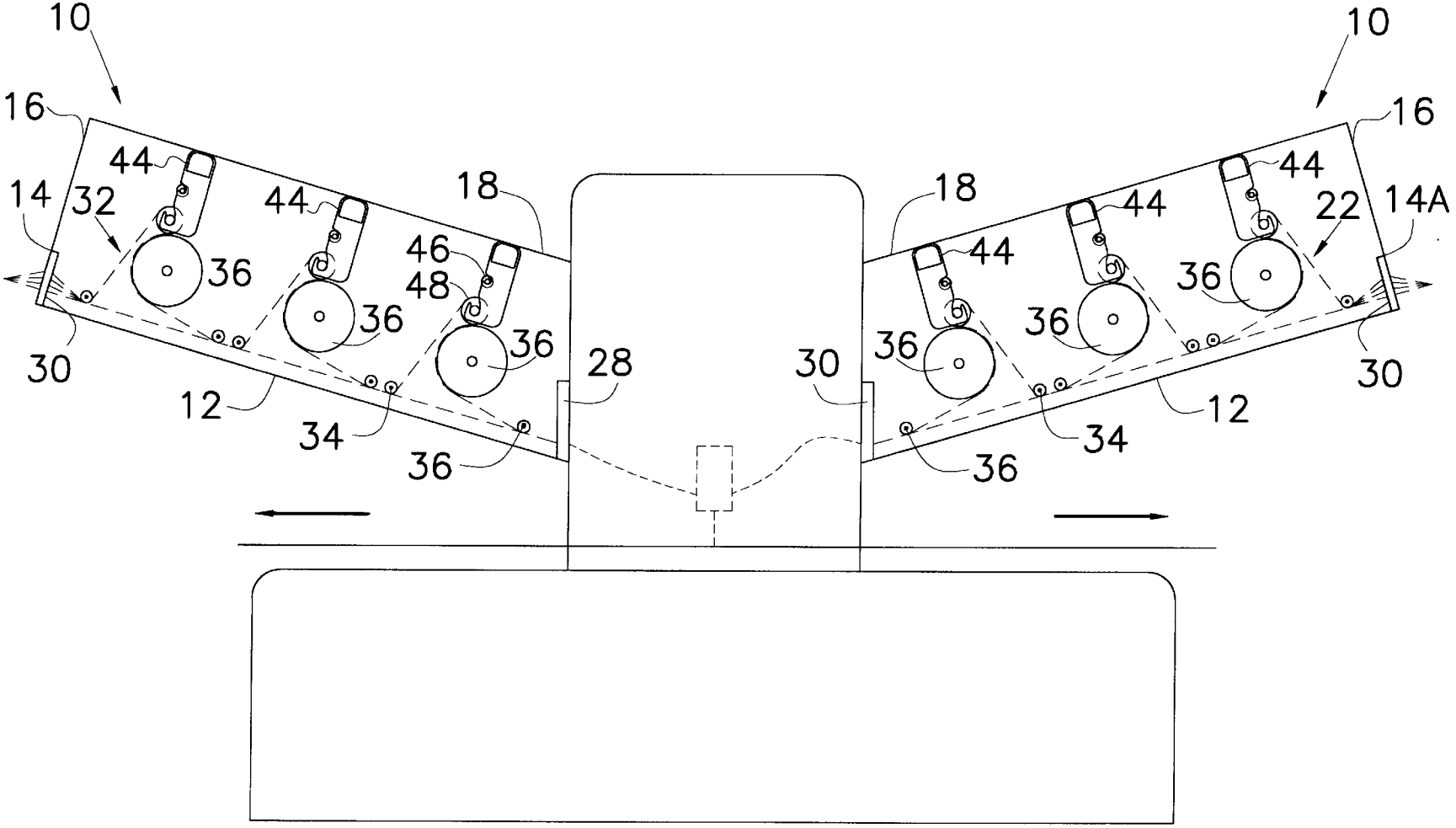
FIG. 3 is an elevation view of one embodiment of the individual yarn feeding apparatus of the present invention.

As illustrated in FIG. 1, the individual yarn feed apparatus 10 of the present invention includes a support arm 12 carried by the tufting machine, at least one thread guide 14 disposed proximate a first end 16 of the support arm 12, and at least one feed rate control device 20 received on the support arm 12. The thread guide 14 separates the individual yarn threads as they pass from the yarn beam, through the apparatus 10, and to the needle bar. The feed rate control device 20 enables the definition of an accent yarn feed path 22 and a base yarn feed path 24. As shown in FIGS. 2 and 3, the individual yarn feeding apparatus 10 is positioned between the yarn beam and the needle bar of a conventional tufting machine. In operation, the device 20 controls the accent yarn thread feed rate to the needle bar, thereby defining a weave pattern in the backing fabric.

The support arm 12 is carried by the tufting machine in a relative parallel position with respect to the base yarn feed path 24. The support arm 12 is fabricated from any durable material capable of bearing the load of at least one feed rate control device 20. The support arm 12 of the preferred embodiment is fabricated from stainless steel. In the preferred embodiment, the support arm 12 carries multiple feed rate control devices 20.

Figure 7:
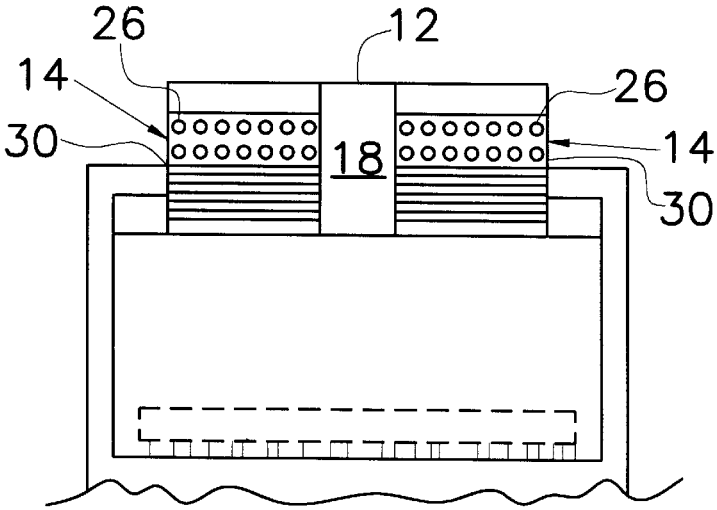
FIG. 7 illustrates an end view of the individual yarn feeding apparatus illustrated in FIG. 3.

As illustrated in FIG. 7, the thread guide 14 includes a plurality of through-openings 26 for separating individual yarn threads as they are fed through the apparatus 10. The individual yarn threads are inserted through the individual through-openings 26 of the thread guide 14 and are fed to the individual needles of the needle bar in conventional fashion. Yarn threads extending from the thread guide 14 to the needle bar define the base yarn feed path 24. The thread guide 14 is fabricated from any material capable of withstanding both the overall structural tension resulting from the simultaneous pulling of multiple yarn threads through the through-openings 26 and the wear resulting from the passage of the yarn threads through each of the individual through-openings 26. Wood, plastic and metal are among the more practical materials for such a fabrication. Depending on the material used, it is foreseeable that the individual through-openings 26 of the thread guide 14 may be polished, coated, or lined with an appropriate material to further minimize or eliminate any friction that can result from the passage of the individual yarn threads through the through-openings 26, thereby reducing the wear to the through-openings 26. The thread guide 14 of the preferred embodiment is fabricated from stainless steel and includes a polished surface area within each of the plurality of through-openings 26 to enhance individual yarn thread passage and minimize wear.

It is foreseeable that more than one thread guide 14 can be incorporated into the individual yarn feeding apparatus 10 of a conventional tufting machine to further reduce the potential for misfeeds in threading yarn threads through the apparatus 10. For example, it is foreseeable that a thread guide 14 can be positioned between each pair of a multiple of feed rate control devices 20 which are disposed on a support arm 12 in a consecutive fashion. Alternatively, it is foreseeable that a thread guide 14 may be incorporated at either end of a support arm 12 bearing consecutively disposed multiple feed rate control devices 20. In the preferred embodiment illustrated in FIG. 3, a proximal thread guide 14A is disposed proximate the first end 16 of the support arm 12 for separating the yarn threads as they are fed from the yarn beam to the apparatus 10. A distal thread guide 30 is disposed proximate a second end 18 of the support arm 12 for maintaining the separation between the yarn threads as they are fed from the apparatus 10 to the needle bar. Those skilled in the art will appreciate that the utility of employing more than one thread feed guide 14 in a yarn feeding apparatus 10 is amplified by coordinatedly numbering or labeling corresponding through-openings 26 of the proximal and distal thread guides 28, 30, respectively.

The feed rate control device 20 includes a support bracket assembly 32, a first and a second thread routing rod 34A,B and a yarn feed roller 36 disposed between the bracket assembly 32 and the thread routing rods. 34A,B The feed rate control device 20 is received by the support arm 12 so as to define a center line which is perpendicular to and above the base yarn feed path 24, as shown in FIG. 1. The center line of the feed rate control device 20 is coincident with a center line defined by the support bracket assembly 32 and a center point defined by the yarn feed roller 36. The thread routing rods 34A,B are disposed in an equidistant lateral position from the center point of the yarn feed roller 36 and in an equidistant vertical position between the center point of the yarn feed roller 36 and the base yarn feed path 24, above the base yarn feed path 24. The feed rate control device 20 is fabricated from conventional, durable materials. The feed rate control device 20 of the preferred embodiment is fabricated from stainless steel.

Those skilled in the art will recognize that the individual yarn feeding apparatus 10 of the present invention is operable just as effectively regardless whether the feed rate control device 20 is disposed above or below the base yarn feed path 24. They will also recognize that a plurality of feed rate control devices 20 may be disposed in consecutive fashion along either or both sides of the support arm 12, as shown in FIGS. 2 and 7. Alternatively, the plurality of feed rate control devices 20 can be disposed in consecutive fashion along a support arm 12 disposed on either or both sides of a conventional tufting machine, as depicted in FIG. 3. FIG. 2 illustrates one embodiment which incorporates multiple individual yarn feeding apparati 10 in a consecutive fashion along both sides of a support arm 12, where the arm 12 extends from one side of the tufting machine. This arrangement enables the weaving of broad areas of backing fabric to facilitate large scale or large volume productions of tufted product. FIG. 3 illustrates an embodiment in which multiple individual yarn feeding apparati 10 are incorporated in consecutive fashion along one side of two support arms 12, where those arms extend from opposite sides of the tufting machine. Such an arrangement enables the weaving of multiple patterns of thread into a narrower area of backing fabric. Each of these embodiments evidences the adaptability of the individual yarn feeding apparatus 10 to meet the objectives and to enhance the efficiency of an individual manufacturer's manufacturing processes, while improving the quality of the tufted product. Additional combinations of these embodiments are foreseeable, as well. In the preferred embodiment, the individual yarn feed apparatus 10 is disposed above the base yarn feed path 24 and includes a plurality of feed rate control devices 20 which are disposed in consecutive fashion on both sides of the support arms 12 which extend from either side of a conventional tufting machine.

Figure 4:
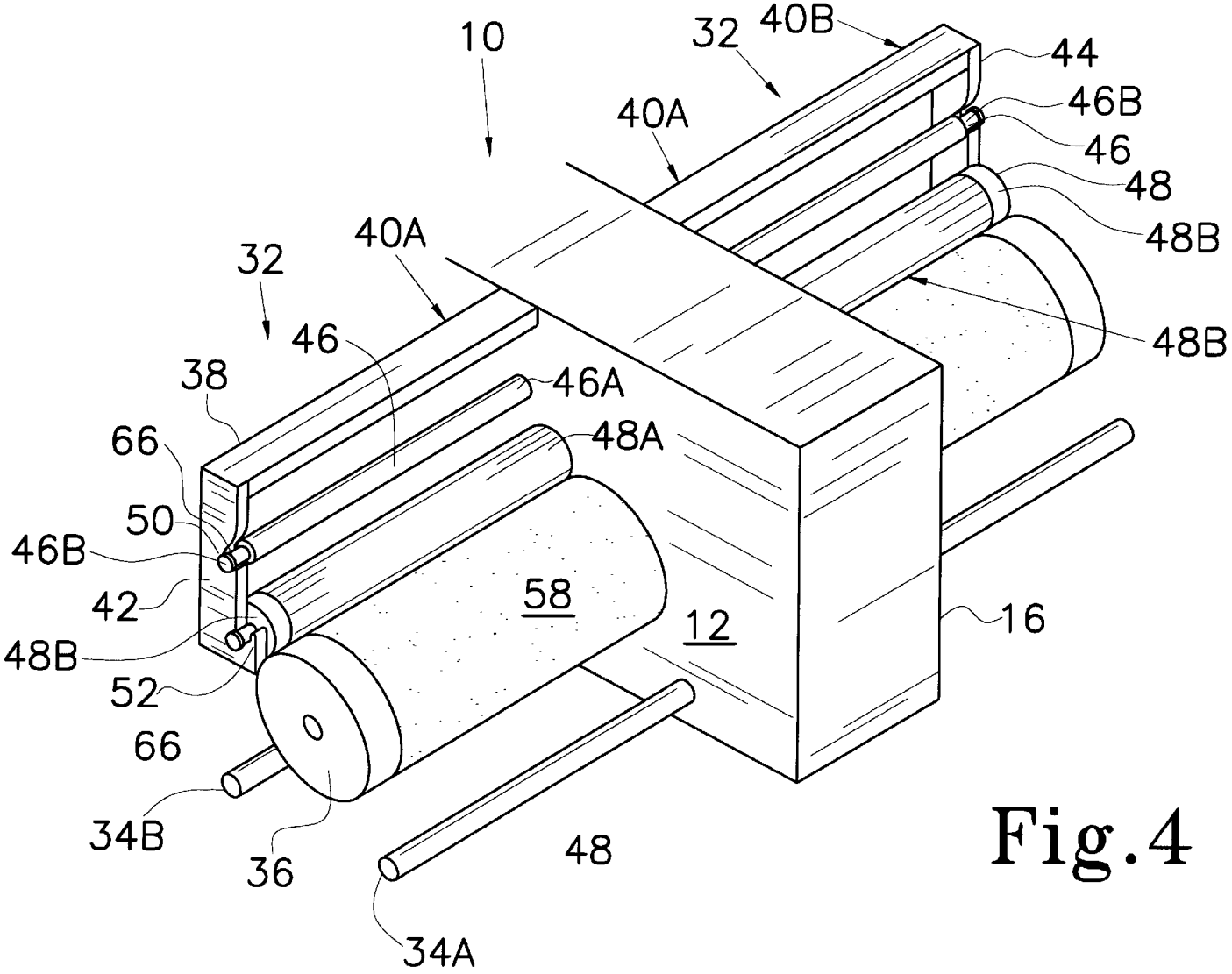
FIG. 4 is an enlarged perspective view of the thread feeding system of the individual yarn feeding apparatus.
Figure 8:
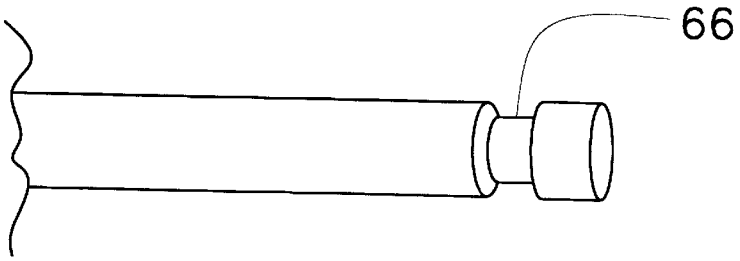
FIG. 8 illustrates an elevation view of a thread grouping rod of the preferred embodiment which includes a grooved end.

As shown in FIG. 4, the support bracket assembly 32 is disposed above the yarn feed roller 36. The support bracket assembly 32 includes a support bracket 38 having a first and a second end 40A,B, a bracket end plate 42 disposed on the second end 40B of the support bracket 38, a thread separating rod 46, and a thread grouping rod 48. The first end 40A of the support bracket 38 is received in the support arm 12. The thread separating rod 46 and the thread grouping rod 48 each have a first end and a second end 46A,B, 48A,B. The first end 46A, 48A of each rod 46,48 is removably received in the support arm 12. The second end 46B, 48B of each rod 46, 48 is removably received in the support bracket end plate 42. The bracket end plate 42 receives each rod 46, 48 in a thread separating rod slot 50 and a thread grouping rod slot 52, respectively. The thread separating rod 46 and the thread grouping rod 48 cooperatively enable the selective grouping of accent yarn threads to create a desired weave pattern and the rapid regrouping of those yarn threads when pattern profile modification or correction is desired. In the preferred embodiment, the support bracket assembly 32 further includes bearings 54 disposed proximate to either or both ends of each rod 46, 48 to further facilitate the free rotation of those rods 46, 48. As illustrated in FIG. 8, the second end 46B, 48B of each rod 46, 48 of the preferred embodiment is journaled 66 to enhance its placement in the bracket end plate 42.

In the preferred embodiment, the support bracket 38 extends to either side of the support arm 12 in the support bracket assembly 32, as illustrated in FIG. 4. The thread separating rod 46, the thread grouping rod 48 and the bracket end plate 42 are correspondingly positioned on both sides of the support arm 12. The slots 50, 52 for receiving the second end 46B, 48B of each respective rod 46, 48 of the preferred embodiment are disposed on a lateral side 44 of the bracket end plate 42. The thread separating rod slot 50 is positioned above the thread grouping rod slot 52 in the bracket end plate 42 of the preferred embodiment. Accordingly, the thread separating rod 46 is positioned above the thread grouping rod 48 in the individual yarn feeding apparatus 10 of preferred embodiment.

The thread separating rod slot 50 of the preferred embodiment is configured in a relatively horizontal orientation to permit ease of use and replacement upon the completion of use. The thread grouping rod slot 52 of the preferred embodiment is configured in a relatively vertically orientation. The orientation of the thread grouping rod slot 52 facilitates control over accent yarn threads in the event of unexpected tension in the threads and minimizes potential loss in the event of thread breakage. In the event of unexpected tension, the configuration of the thread grouping rod slot 52 enables the downward movement of the rod 48 in the slot 52. The downward movement of the rod 48 draws the thread grouping rod 48 into full contact with the yarn feed roller 36, halting the passage of accent yarn threads into the yarn feed roller area. Contact between the roller 36 and the rod 48 restricts the passage of accent yarn threads into the yarn feed roller area at a time of thread breakage and prevents the yarn threads from repeatedly wrapping around the roller 36. The thread grouping rod 48 is manufactured from durable materials and may be variably dimensioned. It is foreseeable that the thread grouping rod surface 56 can be coated with suitable materials or machined to enhance its tractability of the accent yarn threads. In the preferred embodiment, the thread grouping rod 48 includes a surface coating of rubber to enhance its tractability of the yarn threads and is dimensioned to have a diameter of two inches.

The yarn feed roller 36 is centrally positioned between the support bracket assembly 32 and the thread routing rods 34A, B. The yarn feed roller 36 regulates the speed at which the yarn threads are fed to the needle bar of the conventional tufting machine. The thread grouping rod 48 assists the yarn feed roller 36 in regulating yarn thread speed by coordinately tensioning the accent yarn threads as they are drawn through the individual yarn feed apparatus 10. The yarn feed roller 36 and support bracket assembly 32 are positioned such that the points of contact between the yarn feed roller 36 and thread grouping rod 48 define a nip 60. The nip 60 between the rod 48 and the roller 36 enhances the tractability of the yarn threads and the control of the movement of the threads through the apparatus 10. The yarn feed roller 36 is fabricated from conventional, durable materials. In the preferred embodiment, the yarn feed roller 36 is fabricated from stainless steel. The yarn feed roller 36 of the preferred embodiment further includes a contact surface 58 disposed about its circumference to enhance the tractability of the individual yarn threads passing through the nip 60 defined by the roller 36 and the thread grouping rod 48. The enhanced tractability provided by the contact surfaces 56, 58 of both the roller 36 and the rod 48 results from increased friction produced between the individual yarn threads and those surfaces 56, 58. The yarn feed roller contact surface 58 of the preferred embodiment is fabricated from sandpaper.

The first and second thread routing rods 34A, B are positioned immediately above and define the base yarn feed path 24 for all individual yarn threads passing through the individual yarn feeding apparatus to the needle bar. They 34A, B also assist in directing accent yarn threads along the accent yarn feed path 22 defined by the feed rate control device 20. The thread routing rods 34A, B are fabricated from durable materials capable of withstanding the wear caused by the repeated passage of the accent yarn threads. In the preferred embodiment, the thread routing rods 34A, B are fabricated from stainless steel.

Figure 5:
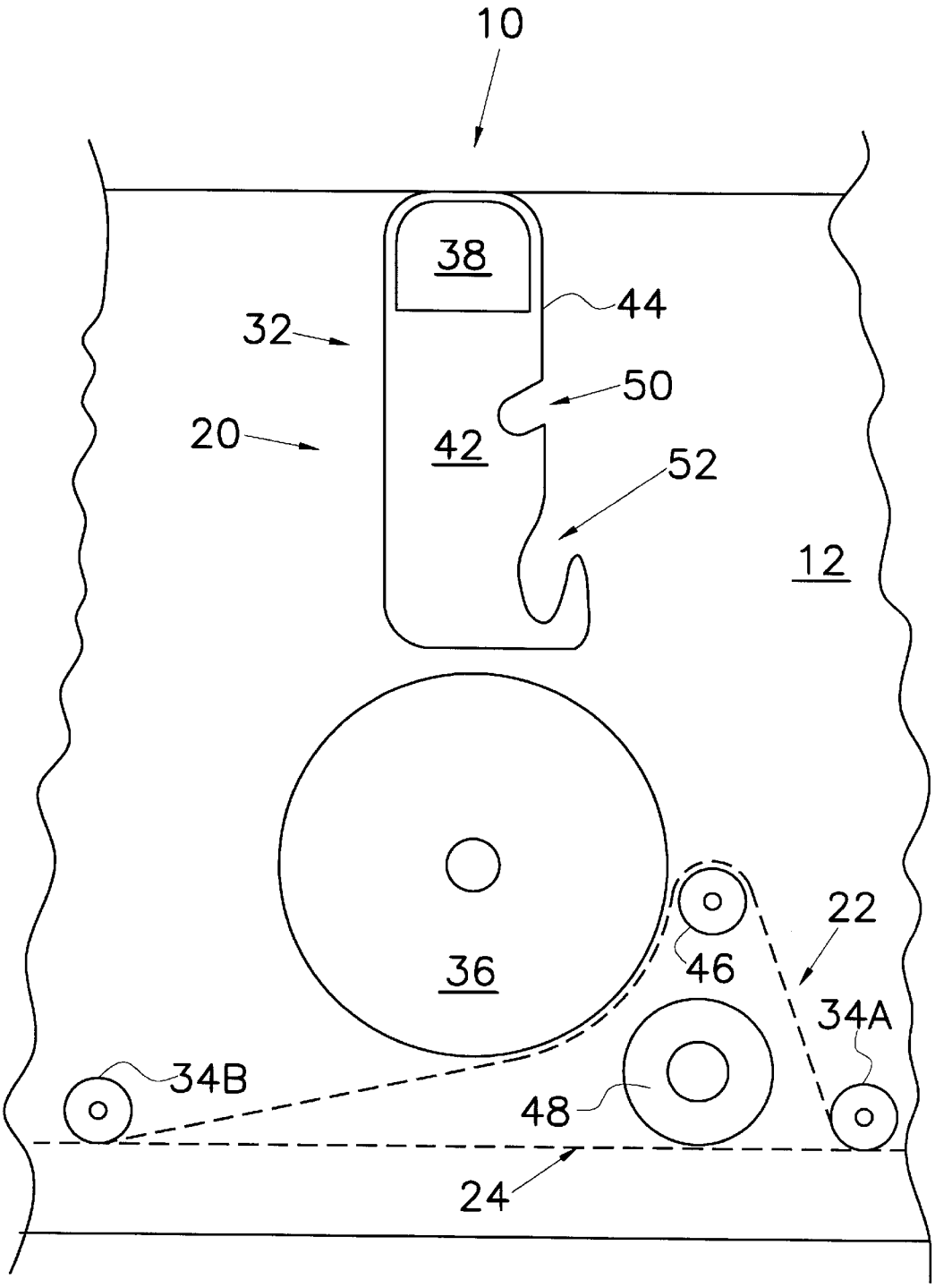
FIG. 5 is an elevation view of one method of selecting accent yarn threads from the base yarn feed path of the individual yarn feed apparatus.
Figure 6:
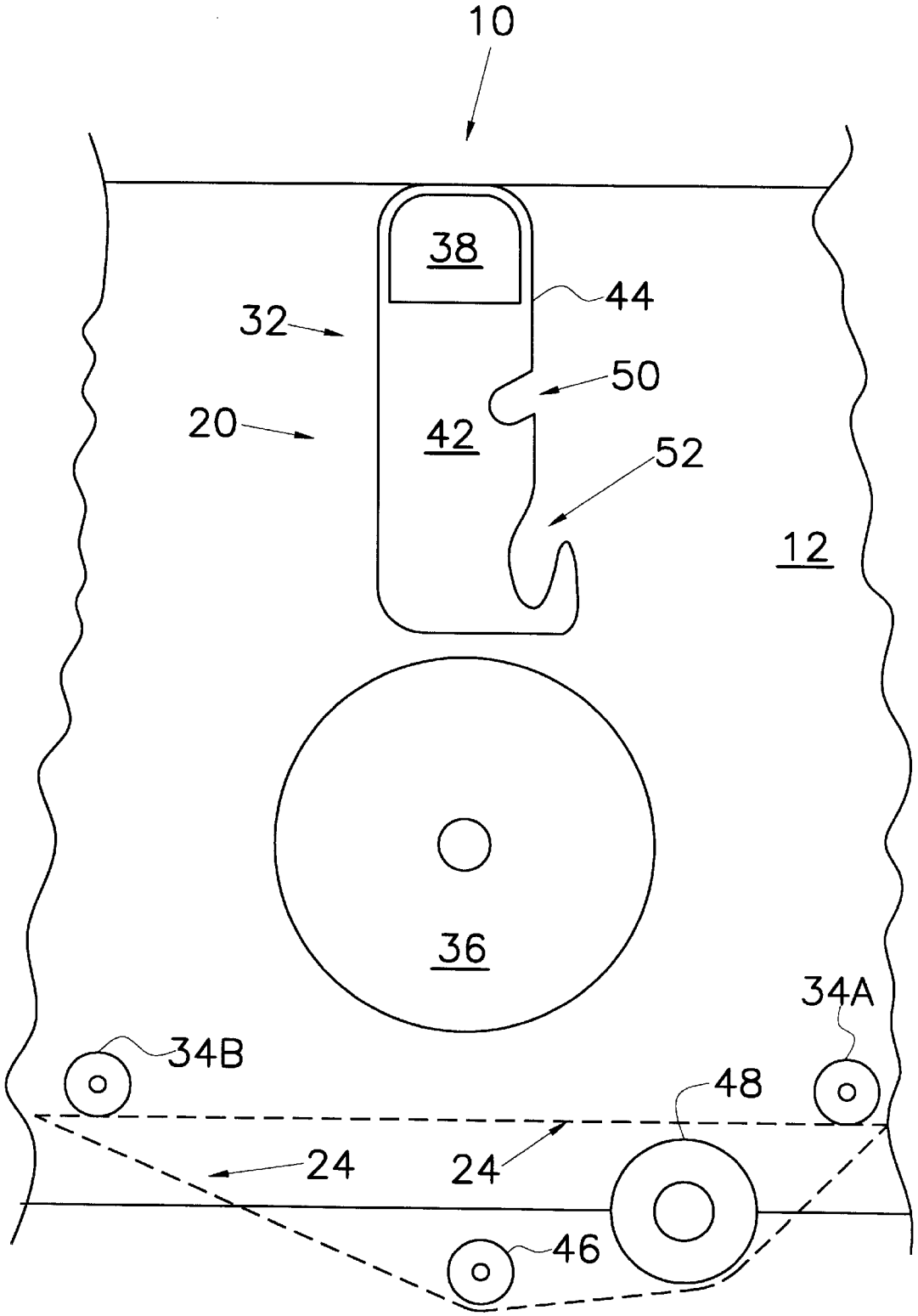
FIG. 6 is an elevation view of another method of selecting accent yarn threads from the base yarn feed path of the individual yarn feed apparatus.

FIGS. 5 and 6 assist in describing the method for setting-up and the operation of the individual yarn feeding apparatus 10. Individual threads of yarn are first fed from the yarn beam through the individual through-openings 26 of the thread guide 14 of the apparatus 10. The threads are then fed to the individual needles of the needle bar in the conventional manner, passing first along the base yarn feed path 24 beneath the first and second thread routing rods 34A, B. Those yarn threads desired as accent yarns for a particular pattern are separated from the base yarn feed path 24 and define the accent yarn feed path 22. The accent yarn feed path 22 is created using the combination of the thread separating and thread grouping rods 46, 48 in either of two above-described manners, and the apparatus 10 is ready for operation. In operation, the accent yarn threads move from the base yarn feed path 22 through the accent yarn feed path 24 defined by the feed rate control device 20, and back down to the base yarn feed path 24. More specifically, the accent yarn threads are moved under the first thread routing rod 34A, over the thread grouping rod 48, around a partial circumference of the yarn feed roller 36, under the second thread routing rod 34B and then back to the base yarn feed path 24. Variations in the speed of weaving the accent yarn threads compensate for the shifting of the needle bars and control the pile height achieved in tufting to define a particular design and pattern of the finished tufted product.

As illustrated generally in FIG. 9, the individual yarn feed apparatus 10 of the preferred embodiment includes a computer 62 for receiving and storing programs that dictate desired designs and patterns for a particular tufted product. An independently regulated motor 64 is also included in the individual yarn feed apparatus 10 of the preferred embodiment to implement the operational commands for each yarn feed roller 36. Individual speed controls (not shown) are housed within each motor 64 to further facilitate regulation of the rate at which the accent yarn threads are fed to the needle bar.

From the foregoing description, it will be recognized by those skilled in the art that an individual yarn feeding apparatus 10 offering advantages over the prior art has been provided. Specifically, the individual yarn feeding apparatus 10 enables the feeding of a plurality of yarn threads from a yarn beam to the needle bars of a conventional tufting machine. The individual yarn feeding apparatus 10 also utilizes a thread guide 14 to facilitate the employment of a plurality of yarn threads while insulating the individual threads from entanglement or combination. The yarn feed apparatus 10 provides a means for quickly selecting the individual yarn threads within a group to be fed using the same feed rate profile. The individual yarn feeding apparatus 10 facilitates the efficient set-up, broken-down or re-set of the yarn feed during a tufting process. The individual yarn feeding apparatus 10 is also easily integrable into a conventional tufting machine system and is readily adapted for engagement of multiple yarn feeding apparati 10 such that broader areas of carpet backing can be woven at one time, thus enhancing overall carpet production.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, we claim:

1. An individual yarn feeding apparatus for individually controlling the feed rate of groups of yarn, said apparatus for being disposed between a yarn beam and a needle bar of a conventional tufting machine, said yarn feeding apparatus comprising:

a support arm carried by the conventional tufting machine;

at least one thread guide carried by said support arm for separating individual threads of yarn received from the yarn beam, said thread guide including a plurality of through-openings, each of said plurality of through openings for receiving one of said individual threads of yarn received from the yarn beam; and at least one feed rate control device for receiving individual yarn threads from said thread guide and for variably feeding the yarn threads to the needle bar of the tufting machine such that said feed rate control device controls the height of the pile to define a particular design and pattern in a tufted products said at least one feed rate control device including a support bracket assembly, a first and a second thread routing rod, and a yarn feed roller disposed between said support bracket assembly and said thread routing rods, said support bracket assembly including a support bracket having a first end and a second end, a bracket end plate disposed on said second end of said support bracket, a thread separating rod and a thread grouping rod, said thread separating rod, said grouping rod, said yarn feed roller and said thread routing rods defining an accent yarn path, said thread separating rod and said thread grouping rod each having a first end received in said support arm and a second end carried by said support bracket, said support bracket end plate defining a thread separating rod slot and a thread grouping rod slot for removably receiving said second end of said thread separating rod and said thread grouping rod, respectively.

2. The individual yarn feeding apparatus of claim 1 wherein said support arm is carried by the tufting machine in a relative parallel position with respect to a base yarn feed path, said base yarn feed path being defined by said at least one feed rate control device.

3. The individual yarn feeding apparatus of claim 1 wherein said feed rate control device defines a center line which is perpendicular to and above said base yarn feed path, said center line of said feed rate control device being coincident with a center line defined by said support bracket assembly and a center point defined by said yarn feed roller, said thread routing rods being disposed in an equidistant lateral position from said center line of said feed rate control device and in an equidistant vertical position between the center point of said yarn feed roller and said base yarn feed path, above said base yarn feed path.

4. The individual yarn feeding apparatus of claim 1 wherein said thread separating rod slot and said thread grouping rod slot are disposed on a first side of said support bracket assembly, said thread separating rod being disposed above said thread grouping rod on said first side of said support bracket assembly.

5. The individual yarn feeding apparatus of claim 1 wherein said thread grouping rod slot is vertically disposed to permit vertical movement of said thread grouping rod in the event of heightened tension of yarn threads passing through said apparatus so as to arrest movement of the yarn threads and preclude breakage of yarn threads in said yarn feed control device.

6. The individual yarn feeding apparatus of claim 1 wherein said thread separating rod and said thread grouping rod further include bearings to optimize the friction-free rotation of said thread separating rod and said thread grouping rod in operation of said yarn feeding apparatus.

7. The individual yarn feeding apparatus of claim 1 wherein said yarn feed roller functions coordinately with said support bracket assembly and said thread routing rods such that said yarn feed roller regulates the speed at which the yarn is fed to the needle bars of a conventional tufting machine, said yarn feed roller and said support bracket assembly being positioned such that a point of contact between said yarn feed roller and said thread grouping rod define a nip, said nip between said rod and said roller for enhancing the tractability of and control over the movement of the yarn threads through said apparatus.

8. The individual yarn feeding apparatus of claim 1 wherein said thread grouping rod and said yarn feed roller are coated with suitable coating materials which heighten tractability and control of the yarn threads passing through said apparatus without interfering with the integrity of or otherwise damaging the yarn threads.

9. The individual yarn feeding apparatus of claim 8 wherein said thread grouping rod is coated with rubber.

10. The individual yarn feeding apparatus of claim 8 wherein said yarn feed roller is coated with sand paper.

11. The individual yarn feeding apparatus of claim 1 wherein said apparatus includes a proximal thread guide and a distal thread guide, said proximal thread guide being disposed proximate to a first end of said support arm, said distal thread guide being disposed proximate a second end of said support arm.

12. The individual yarn feeding apparatus of claim 1 wherein said apparatus includes a plurality of feed rate control devices aligned in a consecutive order along said support arm, and a proximal and a distal thread guide, such that a plurality of groups of yarn threads are simultaneously fed through said apparatus and to the needle bar.

13. The individual yarn feeding apparatus of claim 1 wherein said thread guide and said feed rate control device are disposed along either side of said support arm such that said yarn feed apparatus is operable from two sides of said support arm.

14. The individual yarn feeding apparatus of claim 13 wherein said apparatus includes a plurality of feed rate control devices aligned in a consecutive order along both sides of said support arm such that a plurality of groups of yarn threads are simultaneously fed to the needle bar from both sides of said support arm.

15. The individual yarn feeding apparatus of claim 1 wherein the operation of said feed rate control device is computerized.

16. An individual yarn feeding apparatus for individually controlling the feed rate of groups of yarn, said apparatus for being disposed between a yarn beam and a needle bar of a conventional tufting machine, said yarn feeding apparatus comprising:

a support arm carried by a conventional tufting machine, said support arm being disposed in a relative parallel position with respect to a base yarn feed path;

at least one thread guide carried by said support arm for separating individual threads of yarn received from the yarn beam, said thread guide having a plurality of through-openings for separating individual yarn threads as they are fed through said apparatus, one each for passage of one each of the individual threads of yarn from said yarn beam; and at least one feed rate control device for receiving the individual threads of yarn from said thread guide and variably feeding the yarn threads to the needle bar of the tufting machine, said feed rate control device for individually controlling the feed rate of a group of individual threads of yarn, said feed rate control device including a support bracket assembly having a thread grouping rod, a first and a second thread routing rod, and a yarn feed roller disposed between said bracket assembly and said routing rods, said support bracket assembly being disposed above said yarn feed roller, said yarn feed roller and said support bracket assembly being positioned such that the points of contact between said yarn feed roller and said thread grouping rod define a nip, said nip between said thread grouping rod and said yarn feed roller for enhancing the tractability of and control over the movement of the yarn threads through said apparatus, said thread grouping rod being rubber-coated and said yarn feed roller being sandpaper-coated to heighten the tractability and control of the yarn threads passing through said yarn feed control device, said feed rate control device defining a center line perpendicular to and above said base yarn feed path, said centerline of said feed rate control device being coincident with a center line defined by said support bracket assembly and a center point defined by said yarn feed roller, said thread routing rods being disposed equidistantly and laterally from said center line of said feed rate control device and equidistantly and vertically between said yarn feed roller and said base yarn feed path, said support bracket assembly including a support bracket having a first and a second end, a bracket end plate disposed on said second end of said support bracket, and a thread separating rod, said thread separating rod being positioned above said thread grouping rod on a side of said support bracket end plate, said thread separating rod, said thread grouping rod, said yarn feed roller and said thread routing rods defining an accent yarn feed path, said thread separating rod and said thread grouping rod each having a first end received in said support arm and a second end carried by said support bracket, said support bracket end plate further including a thread separating rod slot and a thread grouping rod slot, said thread grouping rod slot being disposed vertically with respect to said base yarn feed path for permitting vertical movement of said thread grouping rod in the event of heightened yarn thread tension and the arrest the movement of the yarn threads, thereby precluding breakage of the yarn threads in said feed rate control device, said thread separating rod slot and said thread grouping rod slot for removably receiving said second end of said thread separating rod and said thread grouping rod, respectively, and cooperatively enabling grouping of selected accent yarn threads from said accent yarn thread path such that said yarn feed roller variably regulates the rate at which said accent yarn threads are fed to the needle bar of the tufting machine.

17. An individual yarn feeding apparatus for individually controlling the feed rate of groups of yarn, said apparatus for being disposed between a yarn beam and a needle bar of a conventional tufting machine, said yarn feeding apparatus comprising:

a support arm carried by a conventional tufting machine, said support arm being disposed in a relative parallel position with respect to a base yarn feed path;

a proximal and a distal thread guide carried by said support arm, each of said thread guides for separating individual threads of yarn received from said yarn beam, each of said thread guides having a plurality of through-openings for separating individual yarn threads as they are fed through said apparatus, one each for passage of one each of the individual threads of yarn from the yarn beam, said proximal thread guide being disposed proximate to a first end of said support arm, said distal thread guide being disposed proximate a second end of said support arm; and a plurality of feed rate control devices for receiving the individual threads of yarn from said proximal thread guide and variably feeding the yarn threads to the needle bar of the tufting machine, said feed rate control devices for individually controlling the feed rate of a group of yarn threads, the operation of said feed rate control devices being computerized, each of said plurality of feed rate control devices including a support bracket assembly having a thread grouping rod, a first and a second thread routing rod, and a yarn feed roller disposed between said bracket assembly and said thread routing rods, each of said support bracket assemblies being disposed above said yarn feed roller, said yarn feed roller and said support bracket assembly being positioned such that the points of contact between said yarn feed roller and said thread grouping rod define a nip, said nip between said rod and said roller for enhancing the tractability of and control over the movement of the yarn threads through said apparatus, said thread grouping rod having a diameter of two inches, said thread grouping rod being rubber-coated and said yarn feed roller being sandpaper-coated to heighten the tractability and control of the yarn threads passing through said yarn feed control device, each of said feed rate control devices defining a center line perpendicular to and above said base yarn feed path, said centerline of said feed rate control devices being coincident with a center line defined by said support bracket assembly and a center point defined by said yarn feed roller, said thread routing rods being disposed equidistantly and laterally from said center line of each of said feed rate control devices and equidistantly and vertically between said yarn feed roller and said base yarn feed path, each said support bracket assembly including a support bracket having a first end and a second end, a bracket end plate disposed on said second end of said support bracket, and a thread separating rod, said thread separating rod being positioned above said thread grouping rod on a side of said support bracket end plate, said thread separating rod, said thread grouping rod, said yarn feed roller and said thread routing rods defining an accent yarn feed path, said thread separating rod and said thread grouping rod each having a first end received in said support arm and a second end carried by said support bracket, said support bracket end plate further including a thread separating rod slot and a thread grouping rod slot, said thread grouping rod slot being vertically disposed with respect to said base yarn feed path for permitting vertical movement of said thread grouping rod in the event of heightened yarn thread tension and the arrest the movement of the yarn threads, thereby precluding breakage of the yarn threads in said feed rate control device, said respective rod slots for removably receiving said second end of said thread separating rod and said thread grouping rod and cooperatively enabling the grouping of selected accent yarn threads from said accent yarn thread path such that said yarn feed roller variably regulates the rate at which said accent yarn threads are fed to the needle bar of the tufting machine.

* * * * *